US006845524B2

(12) United States Patent
Hwang

(10) Patent No.: US 6,845,524 B2
(45) Date of Patent: Jan. 25, 2005

(54) MANUAL AND AUTOMATIC FLUSHER

(75) Inventor: Su Hwang, Nan-Tou (TW)

(73) Assignee: Hydrotek Corporation, Nan-Tou (TW)

( * ) Notice: Subject to any disclaimer, the term of this patent is extended or adjusted under 35 U.S.C. 154(b) by 37 days.

(21) Appl. No.: 10/458,223

(22) Filed: Jun. 11, 2003

(65) Prior Publication Data

US 2004/0250343 A1 Dec. 16, 2004

(51) Int. Cl.[7] ..... E03D 13/00
(52) U.S. Cl. ..... 4/304; 4/DIG. 3; 251/40
(58) Field of Search ..... 4/304, 302, 305, 4/DIG. 3, 623; 251/40, 26, 30.3; 137/550, 544

(56) References Cited

U.S. PATENT DOCUMENTS 4,327,891 A * 5/1982 Allen et al. ..... 251/40
4,793,588 A * 12/1988 Laverty, Jr. ..... 4/DIG. 3
5,169,118 A * 12/1992 Whiteside ..... 4/DIG. 3
5,431,181 A * 7/1995 Saadi et al. ..... 4/DIG. 3
5,699,994 A * 12/1997 Wu ..... 251/129.03
6,019,343 A * 2/2000 Tsai ..... 251/40
6,349,921 B1 * 2/2002 Jahrling ..... 4/406
6,382,586 B1 * 5/2002 Wilson et al. ..... 251/40
6,659,420 B2 * 12/2003 Hwang et al. ..... 251/40
2003/0042446 A1 * 3/2003 Wilson

* cited by examiner

*Primary Examiner*—Gregory L. Huson
*Assistant Examiner*—Khoa Huynh
(74) *Attorney, Agent, or Firm*—Troxell Law Office PLLC

(57) ABSTRACT

A manual and automatic flusher includes an infrared sensor added to a conventional manual flusher, and the infrared sensor consists of an electronic eye and an electro-magnetic valve. The electro-magnetic valve has an iron core moved in and out for controlling opening and shutting of a block, and a communicating tube connected between a flow hole of the block and the upper end of a valve body to enable a hand rod and the infrared sensor separately operated by means of the flexibility of the communicating tube, not interfering with each other. Then the flusher can be used by a manual operation or by automatic operation, with a simple structure for manufacturing.

8 Claims, 8 Drawing Sheets

MANUAL AND AUTOMATIC FLUSHER

BACKGROUND OF THE INVENTION

1. Field of the Invention

This invention relates to a manual and automatic flusher, particularly to one operable manually and automatically and having a simple structure to be easily made so as to lower its cost.

2. Description of Prior Art

Nowadays a flusher used for a toilet is quite indispensable both in personal houses and public buildings. And a conventional manual flusher was disclosed in a U.S. Pat. No. 4,327,891, which includes a hand rod for forcing a valve to incline to cause a pressure releasing passageway to let water to flow and permitting a film so far pressed down to recover its position and move up to let water to flow in a large volume out of an outlet passageway for flushing a toilet. This manual flusher can operate by gripping directly the hand rod, so the hand rod may become dirty, and should a user forget or not press the hand rod, the toilet may produce bad odor and pollute the environment.

Further, a conventional automatic flusher was disclosed in a U.S. Pat. No. 4,793,588, which includes an infrared sensor in an upper portion, and an electric-magnetic valve provided in the infrared sensor having a iron core to be moved out and in so that a pressure releasing passageway may be controlled to open and close so that a pressure-adding room storing water may be reduced in its pressure to let a film to move up for water to flow out of an outlet passageway, obtaining automatic flushing effect.

However, the conventional automatic flusher has the following disadvantages.

1. It depends on the infrared sensor and the electromagnetic valve to operate flushing, and if these electronic components get out of order, the flusher has to be repaired before it can be used to flush water, needing a period of waiting time required in its repair, very embarrassing
2. It needs an electric power of DC or AC, so no matter which is its power, if the AC power happens outage or the DC of a battery is used up, the flusher has to wait until its power is recovered, not convenient.
3. It depends on the infrared sensor for flushing water, it cannot continue to let water flushed as the manual flusher for continuously keep water flushed out by keeping pressing the hand rod.

SUMMARY OF THE INVENTION

The purpose of the invention is to offer a manual and automatic flusher, possible to be used normally by the automatic mode and to be used manually in case of the automatic mode gets out of order, without need of waiting the automatic structure repaired.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
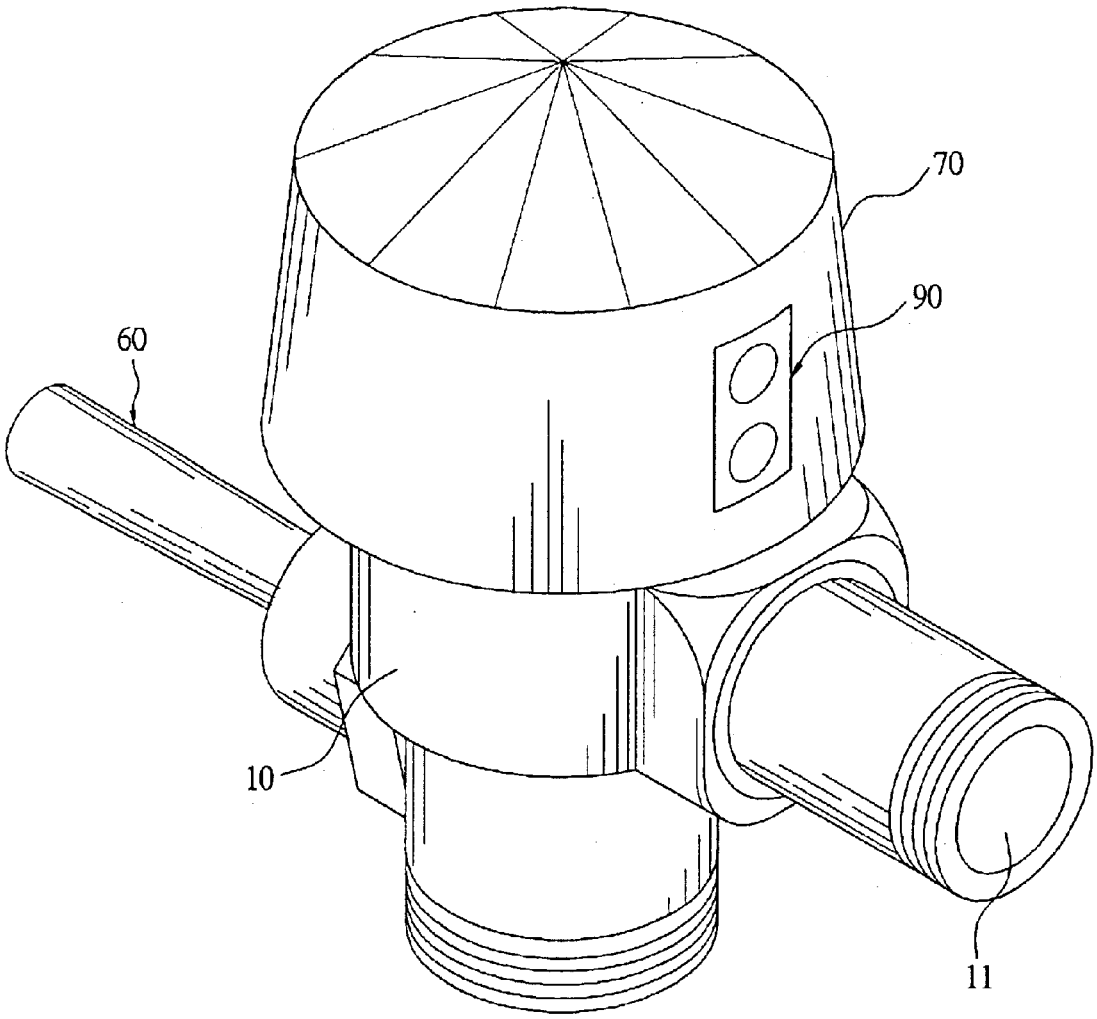
FIG. 1 is a perspective view of a manual and automatic flusher in the present invention.
Figure 2:
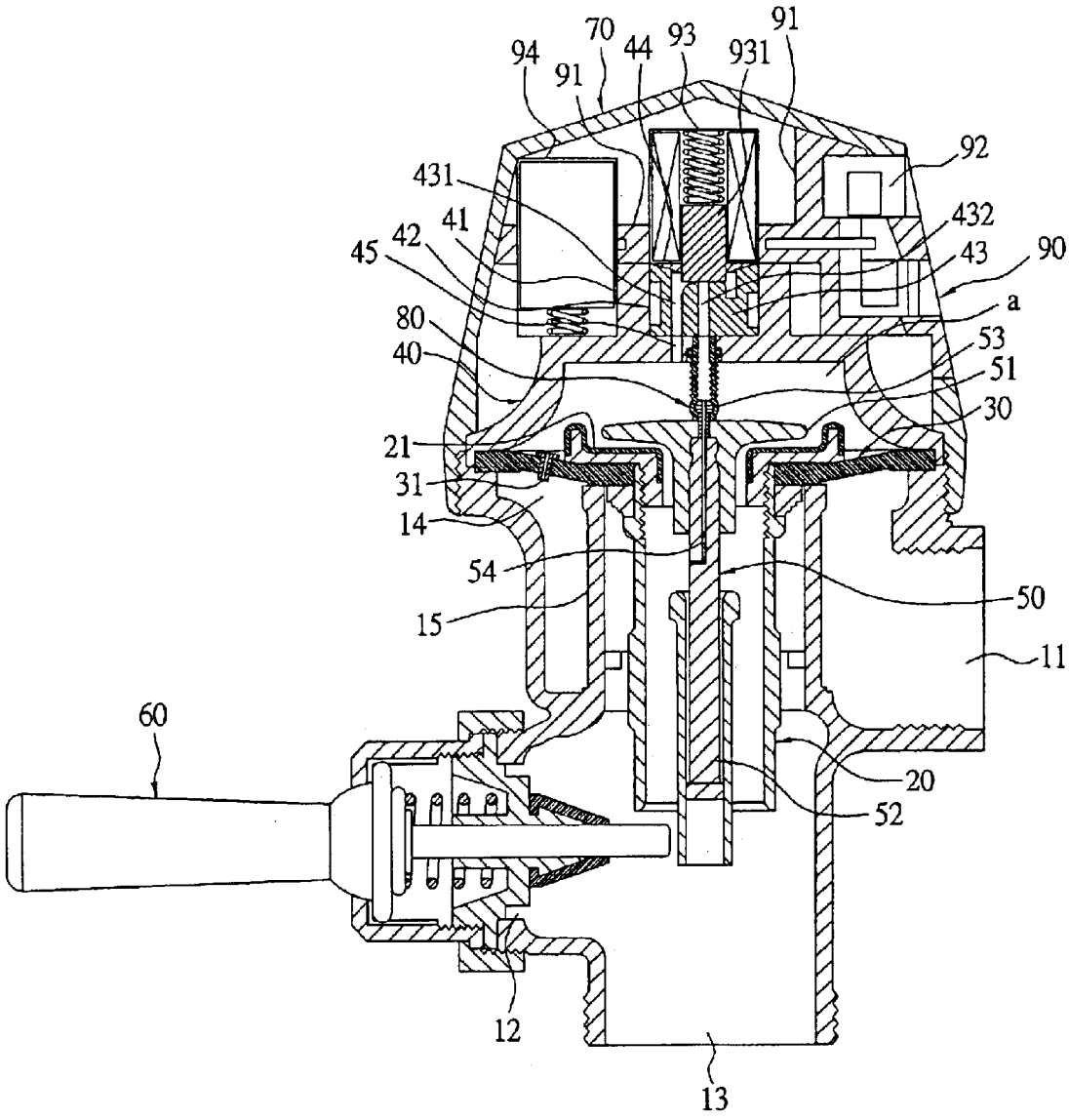
FIG. 2 is a side cross-sectional view of the automatic flusher in the present invention.
Figure 3:
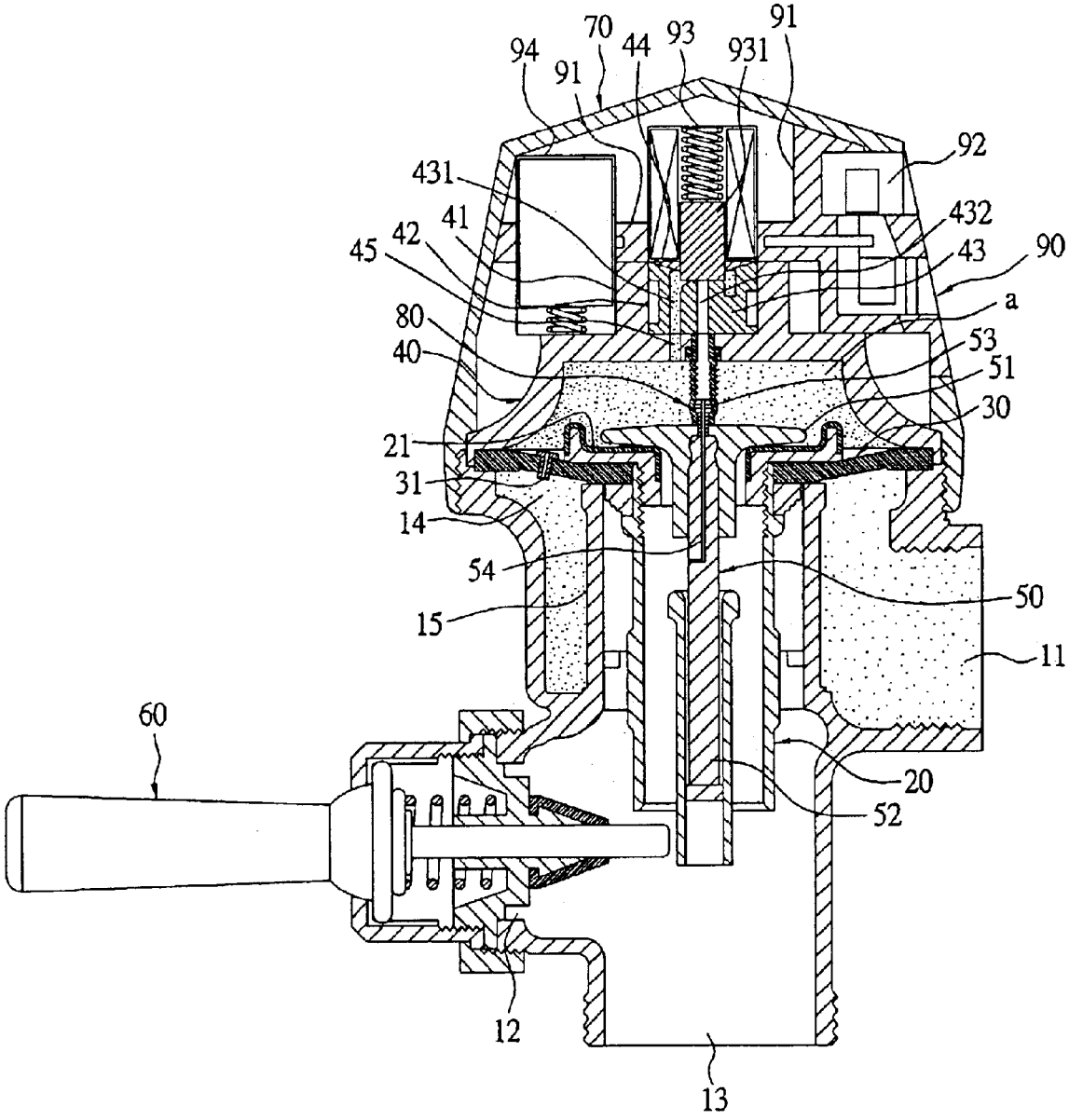
FIG. 3 is the side cross-sectional view of the manual and automatic flusher in the present invention, showing it filled with water.
Figure 4:
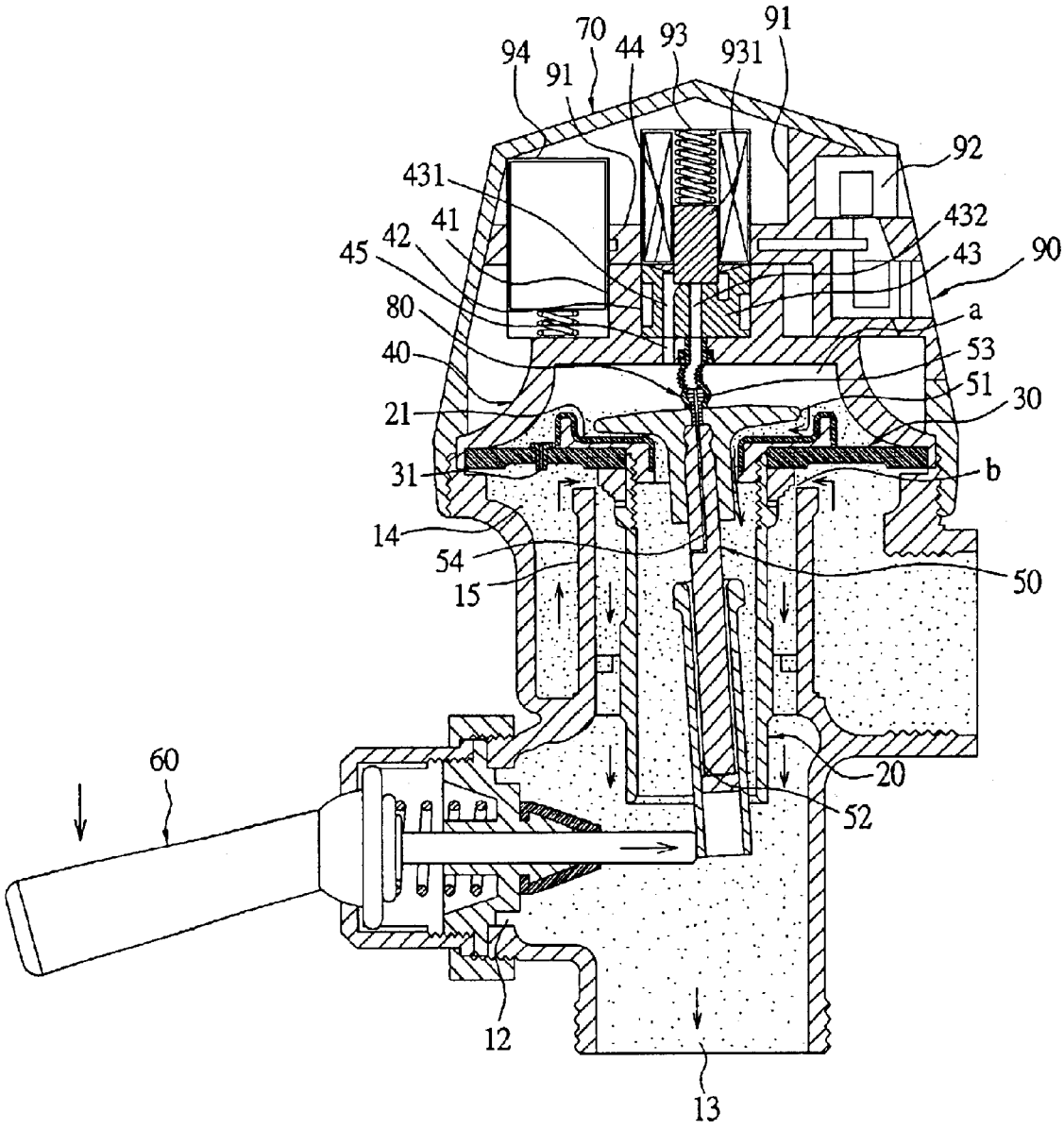
FIG. 4 is a side cross-sectional view of the manual and automatic flusher in the present invention, showing manual flushing.
Figure 5:
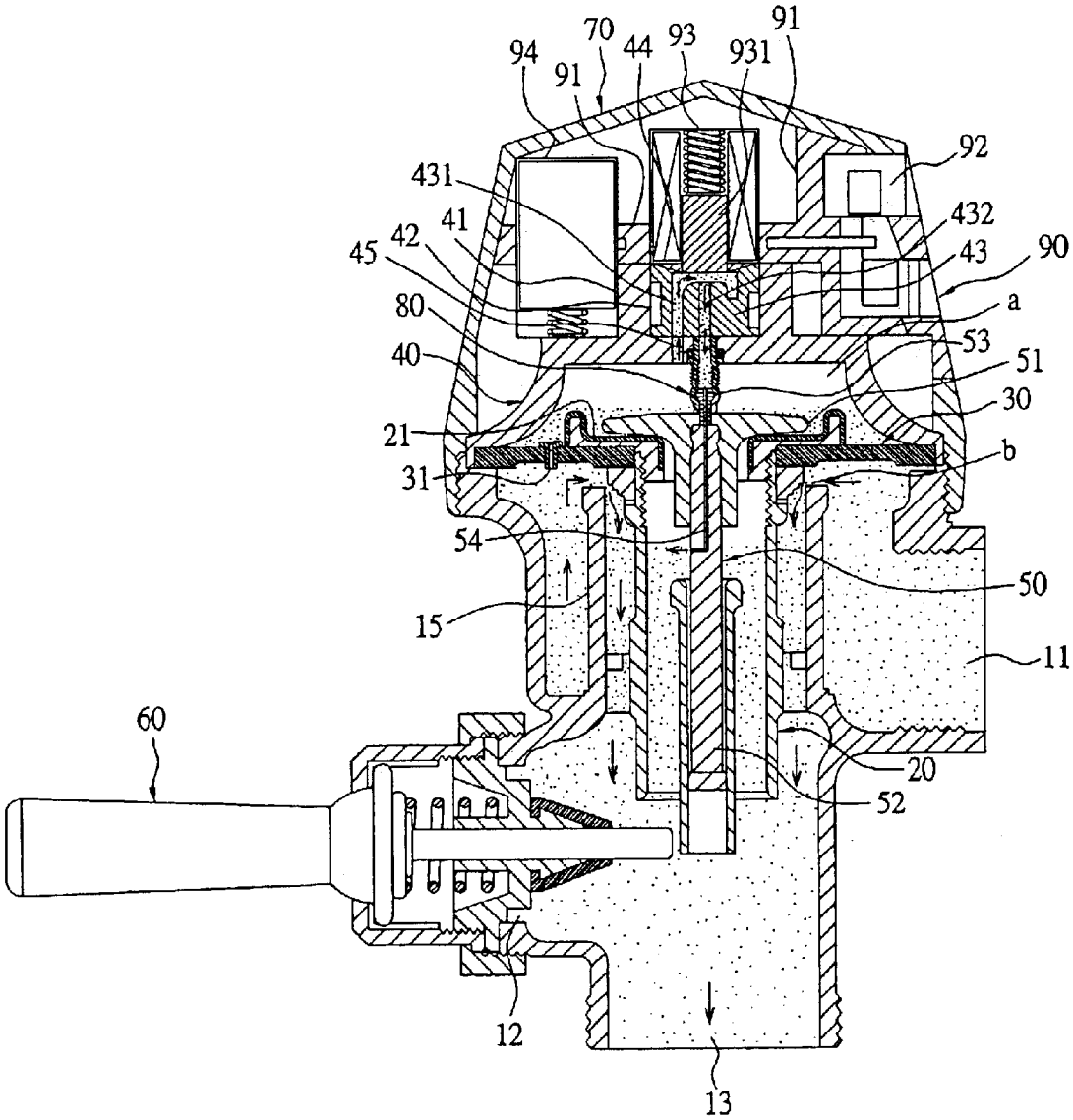
FIG. 5 is a side cross-sectional view of the manual and automatic flusher in the present invention showing automatic flushing.

The preferred embodiment of a manual and automatic flusher in the present invention, as shown in FIGS. 1, 2 and 3, includes a cup member 10, a base tube 20, a film 30, a pressure cap 40, a valve body 50, a hand rod 60, an upper cap 70, a communicating tube 80 and an infrared sensor 90 as main components combined together.

The cup member 10 is provided with an inlet 11, a combine hole 12, an outlet 13, and a chamber 14. A tubular base 15 extends upright on the bottom of the chamber 14, The base tube 20 is firmly fixed inside the tubular base 15, having a close groove 21 formed in the upper portion for an upper disc member 51 of the valve body 50 to press thereon. The film 30 with, a through hole 31 is fixed on the upper end of the base tube 20, having its circumference pressed by the lower annular edge of the pressure cap 40. Thus the upper cap 40, the film 30, the base tube 20 and the upper disc member 51 define a pressure-adding room (a), which communicates with the inlet 11 via the through hole 31 of the film 30, the space between the circumference of the base tube 20 and the cup member 10. The valve body 50 has a pillar member 52 and an upper disc member 51 fixed with the pillar member 52, and an insert head 53 is inserted in the center of the disc member 51, and a flow passageway 54 formed in the center of the pillar member 52 under the insert head 53 to communicate with the outlet 13 of the cup member 10. The hand rod 60 is fixed with the opening outlet 12 of the cup member 10, possible to be pressed down to force its end push against the end of the pillar member 52 so that a gap may formed between the close groove 21 of he base tube 20 and the disc member 51 of the valve body 50, permitting the pressure-adding room (a) communicate with the outlet 13 of the cup member 10 via the interior of the base tube 20. The upper cap 70 is closed on the cup member 10.

Therefore, when the hand rod 60 is pressed down, the water normally stored in the pressure-adding room (a) can flow through the gap formed in the valve body 50 and the close groove 21 and then through the base tube 20. Then the water pressure in the pressure-adding room 9 (a) may decrease, and the pressure under the film 30 will increase more than that in the pressure-adding room (a), forcing the film 30 move upward to form a flowing gap (b) between the film 30 and the tubular base 15 and the space between the base tube 20 and the annular base 15, permitting a large quantity of water flow in through the inlet 11 and then out of the outlet 13 for flushing a toilet. The flushing action may continue until the film 30 moves down to the original position, with the pressure-adding room 9 (a) filled with water. However, this kind of operational function is the same as the conventional flusher. The special feature of the invention is to be described below.

The valve body 50 has an insert head 53 inserted in the center of the upper disc member 51 and a flow passageway 54 formed in the pillar member 51 to communicate with the outlet 13 of the cup member 13.

The pressure cap 40 has an annular wall 41 of a small diameter formed in an upper portion, and a position groove 42 inside the annular wall 41, a block 43 contained in the position groove 42, a sealing gasket 44 closing the opening of the position groove 42 to seal the, block 43 therein. Further, the pressure cap 40 has a through hole 431 to correspond to a through hole 54 formed in the pressure cap 40 to communicate with the pressure-adding room (a), and a flowing hole 432 in the center to communicate indirectly with the through hole 431 via the sealed space of the position groove 42.

The communicating tube 80 is a bellows-shaped flexible tube, having one end connected to the bottom of the flowing hole 432 and the other end fitting firmly around the upper end of the flow passageway 50 of the insert head 53, letting the pressure-adding room (a) indirectly connected with the outlet 13 via the communicating tube 80.

Figure 6:
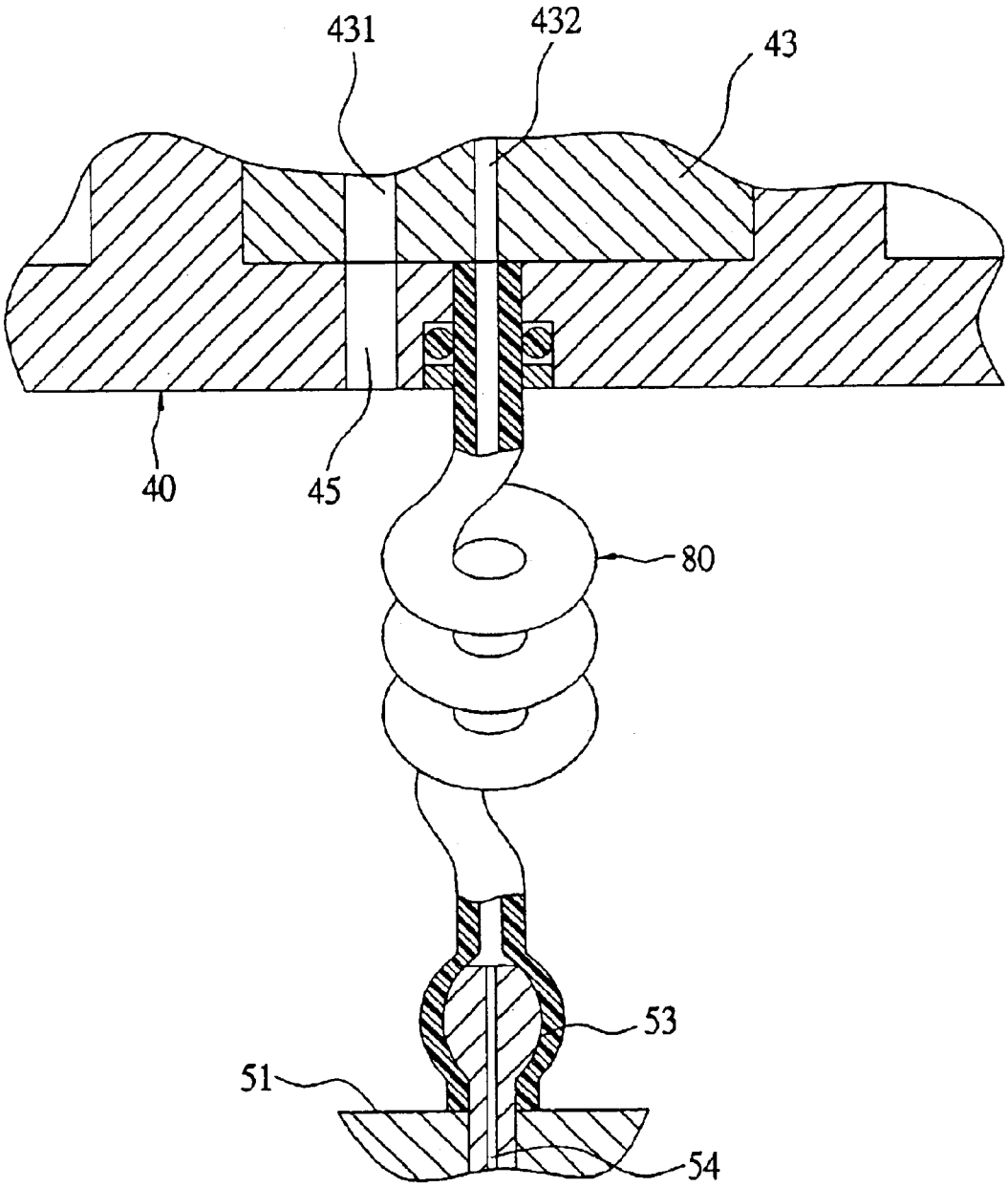
FIG. 6 is a cross-sectional view of a second embodiment of a communicating tube in the present invention.
Figure 7:
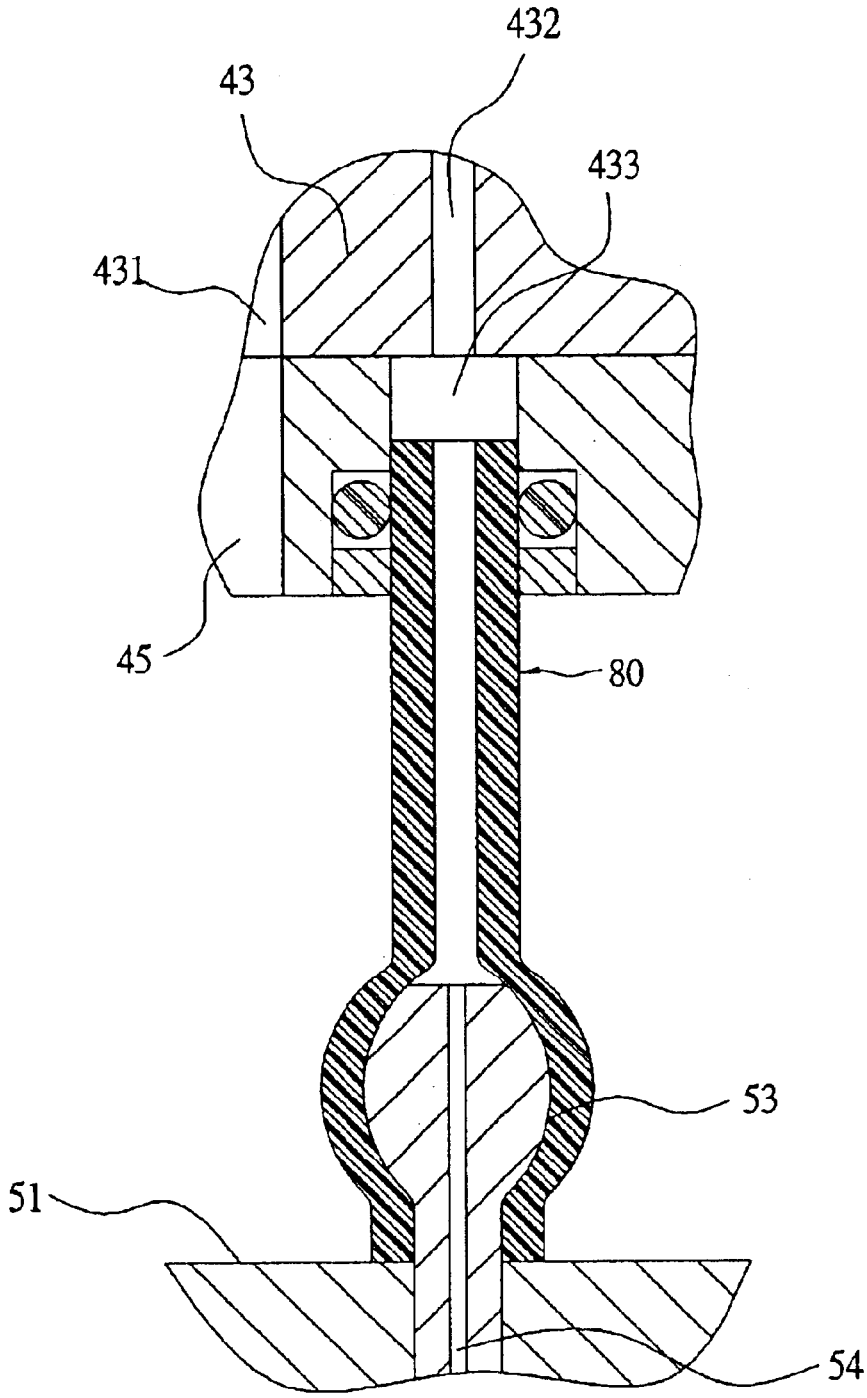
FIG. 7 is a cross-sectional view of a third embodiment of a communicating tube in the present invention; and, FIG. 8 is a cross-sectional view of a fourth embodiment of a communicating tube in the present invention.
Figure 8:
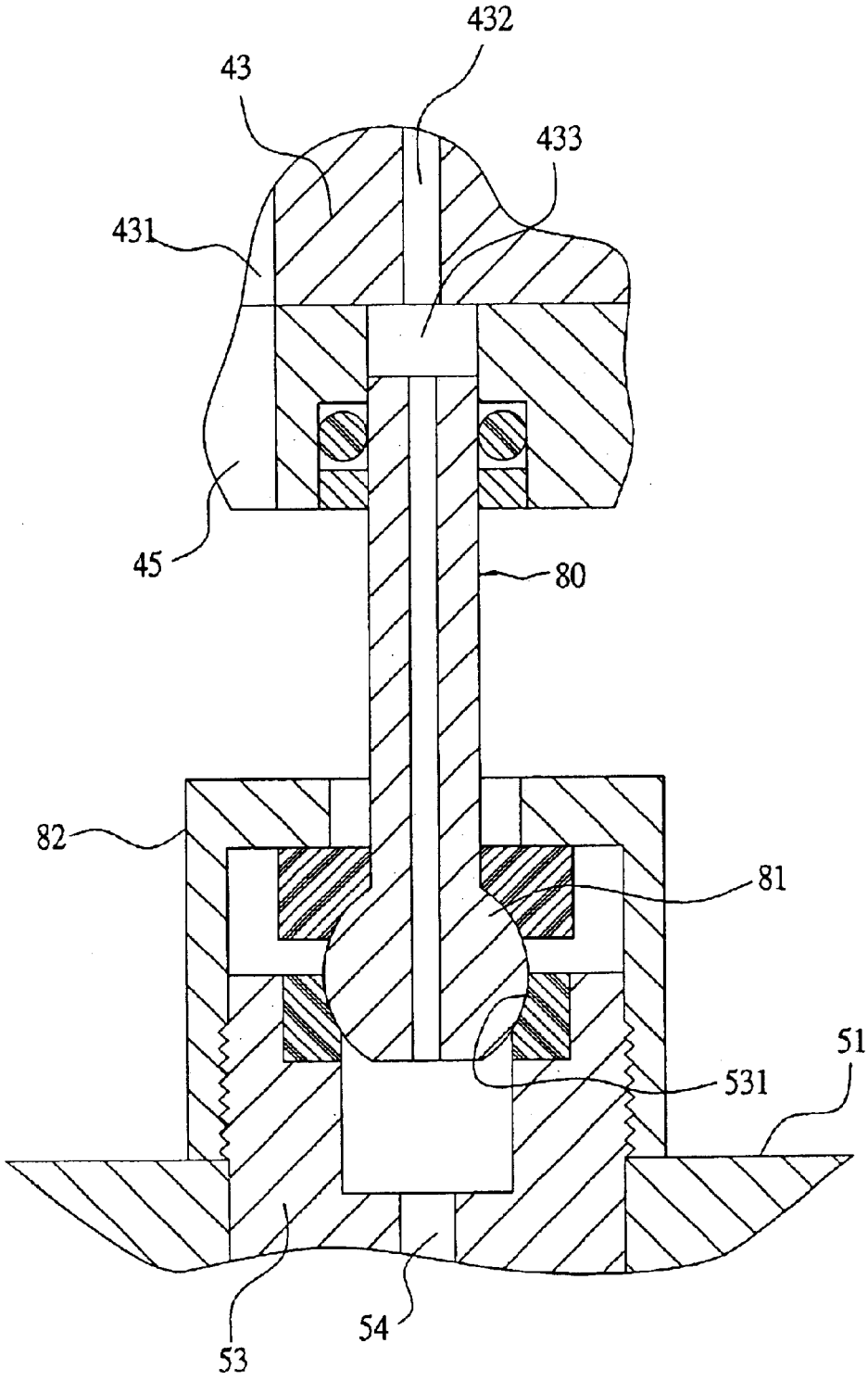

The infrared sensor 90 consists of a fixing frame 91 fixed between the upper cap 70 and the pressure cap 40, an electronic eye 92 fixed on the fixing frame 91, an electro-magnetic valve 93 fixed in the center of the fixing frame 91, and a power device 94 fixed on the opposite side of the electronic eye 92. The iron core of the electro-magnetic valve 93 penetrates through the seal gasket 44 downward, possible to be moved up and down by sensing of the electronic eye 92 to press in due time the block 43 on the flow hole 432 to control the pressure-releasing passageway of the pressure-adding room (a) so as to control flushing action Next, it is to be specially mentioned that the communicating tube 80 can be a bellows-shaped flexible tube, but also can be a helical flexible tube as shown in FIG. 6, or a straight flexible tube as shown in FIG. 7. And if the straight flexible tube is used, it is necessary to leave a spare space 433 to correspond to the block 43 for the communicating tube 80 to move up. The communicating tube 80 can also be a rigid tube as shown in FIG. 8, having a spherical member 81 formed in the lower end to fit in a spherical groove 531 formed in an upper portion of the insert head 53, and a threaded cap 53 to engage with the insert head 53 to keep the spherical member 81 connected with the insert head 53. Then in conjunction with the spare space 433 of the block 43, the valve body 50 can incline with the lower end of the rigid communicating tube 80.

Next, the manual function and the automatic function of flushing with the invention will be described below.

AS for the manual function, when a user presses down the hand rod 60, the hand rod 60 will touch and move the pillar member 52 of the valve body 50 to incline for a preset angle to just form a gap between the disc member 51 of the valve body 50 and the close groove 21 at the upper end of the base tube 20 to produce pressure releasing effect, with the film 30 moving to cause a gap for a large quantity of water flowing through the inlet 11 in the interior of the cup member 10 and out of the outlet 13 into a toilet. So far the flushing action just mentioned is the same as the conventional flusher, and it has to be noticed that the communicating tube 80 has a flexible specialty, not affecting the inclining action and up-and-down movement of the valve body 50, ensuring manual operation of flushing smoothly carried out.

As for the automatic function, when a user comes near to the flusher to trigger the infrared sensor 90, the electro-magnetic valve 93 is started to generate magnetism, with the iron core 931 attracted to move inward. At this moment, the flow hole 432 of the block 43 in the pressure cap 40 becomes open to force the water in the pressure-adding room (a) flow through the through hole 45 of the pressure cap 40, the through hole 431 of the block 43, the flow hole 432 of the block 43, the communicating tube 80 and the passageway 54 of the valve body 50, producing pressure releasing action, just as the action of the conventional flusher, that is, with the film 30 moved to form a flowing gap (b) for a large quantity of water coming from the inlet 11 flowing out of the outlet 13 for flushing a toilet, as described above.

Further, it is worthy to say that if the hand rod 60 is released or the source of sense disappears out of the sensing scope of the electric eye 92 of the infra red sensor 90, the leaking passageway between the valve body 50 and the base tube 20 or that between the iron core 931 and the block 43 will recover at once closing condition, forcing water to flow into the pressure-adding room (a) to be gradually filled with water, with the film 30 moved down to stop flushing immediately, keeping correct function of flushing without fail.

The invention has the following advantages, as can be seen from the foresaid description.

1. The manual mode of flushing can be used, in case the automatic mode cannot function owing to the infrared sensor getting out of order, not necessary to wait until the infrared sensor is repaired.
2. The hand rod can be kept under pressed condition to let water continue to flush out into a toilet to use as much water as wanted, for convenience of washing the toilet, removing the inconvenience of impossibility of controlling the conventional flusher.
3. It can use many components of the conventional manual flusher and the conventional automatic flusher, with appliance of the communication tube used in the invention, and very profitable in manufacturing.

While the preferred embodiment of the invention has been described above, it will be recognized and understood that various modifications may be made therein and the appended claims are intended to cover all modifications that may fall within the spirit and scope of the invention.

What is claimed is:

1. A manual and automatic flusher comprising:

a cup member provided with an inlet, a combine opening, an outlet, and a chamber, said chamber containing a tubular base;

a hand rod fixed within said combine opening for a hand of a user to press down;

a base tube fixed inside said tubular base, a film connected to an upper end of said base tube, said film having a through hole formed on an upper surface of said film, and a close groove formed on an upper portion of said film;

a valve body having a pillar member, an upper disc member connected to the pillar member, and an insert head having one end inserted in the center of the disc member and an opposite end protruding above said disc member, said pillar member having an upper end penetrating upwardly through said close groove of said film and a lower end extending downwardly and out of said base tube to be moved to incline for a proper angle by the pressing of said hand rod, said valve body having a center flow passageway extending through from said upper end of said pillar member and terminating proximately at the middle portion of said pillar member, said center flow passageway is in fluid communication with said outlet of said cup member;

a pressure cap having a circumference fixed with low pressure on the circumference of said film forming a pressure-adding room with said close groove, said film and the upper wall of said valve body, said through hole of said film communicating with said inlet, said pressure cap having a block sealed on its upper surface, said block having a through hole in its outer edge and a flow hole in the center, said through hole and said flow hole communicating with each other in said pressure cap, said through hole communicating with said pressure-adding room;

a communicating tube having an end connected to a lower end of said flow hole of said block and an opposite end connected to said opposite protruding end of said insert head, said communicating tube substantially aligned with said flow passageway of said body to shrink and incline properly with said valve body; and an infrared sensor provided on said pressure cap, said infrared sensor having an electronic eye, an electromagnetic valve controlled by said electronic eye, and an iron core provided in said electromagnetic valve to move inward and outward to close an upper opening of said flow hole of said block to control opening and shutting of said flow hole; wherein said hand rod or said infrared sensor is to be pressed or to be triggered by the user for manually or automatically flushing water out of said flusher into a toilet.

2. The manual and automatic flusher as claimed in claim 1, wherein an insert head is further provided to insert in an upper end of said passageway of said valve body for connecting said communicating tube.

3. The manual and automatic flusher as claimed in claim 1, wherein said pressure cap further has an annular wall provided to extend up on an upper surface, and a position groove is defined by said annular wall for receiving a block therein, with a seal gasket closing on an opening of said position groove to seal said block.

4. The manual and automatic flusher as claimed in claim 1, wherein said electronic eye and said electro-magnetic valve of said infrared sensor are fixed on a fixing frame, which is fixed between said pressure cap and an upper cap provided above said pressure cap and closing on said cup member.

5. The manual and automatic flusher as claimed in claim 1, wherein said communicating tube is a bellow-shaped flexible tube.

6. The manual and automatic flusher as claimed in claim 1, wherein said communicating tube is a helical flexible tube.

7. The manual and automatic flusher as claimed in claim 1, wherein said communicating tube is a straight flexible tube, and a spare space is provided between said block and an upper end of said communicating tube for said communicating tube to move up.

8. The manual and automatic flusher as claimed in claim 1, wherein said communicating tube is a rigid tube, which has a spherical member formed in a lower end to fit in said insert head of said valve body so as to incline properly, and a spare space is provided between said valve body and said upper end of said communicating tube for said communicating tube to move up.

* * * * *